United States Patent [19]

Noda et al.

[11] Patent Number: 4,553,399

[45] Date of Patent: Nov. 19, 1985

[54] METHOD OF LUBRICATING BEARINGS OF A REFRIGERATION OR THE LIKE COMPRESSOR

[75] Inventors: Sadafumi Noda, Isahaya, Japan; Bernard Zimmern, Vantage Point Condominium, 6 New St., East Norwalk, Conn. 06855

[73] Assignee: Bernard Zimmern, East Norwalk, Conn.

[21] Appl. No.: 597,120

[22] Filed: Apr. 5, 1984

[30] Foreign Application Priority Data

Apr. 14, 1983 [FR] France ..... 83 06079

[51] Int. Cl.[4] ..... F25B 43/02

[52] U.S. Cl. ..... 62/84; 62/469

[58] Field of Search ..... 62/505, 193, 192, 84, 62/469, 468, 470, 471, 472, 473

[56] References Cited

U.S. PATENT DOCUMENTS

| | | | |
|---|---|---|---|
| 1,605,998 | 11/1926 | Strobell | 62/469 X |
| 3,241,331 | 3/1966 | Endress et al. | 62/505 X |
| 3,820,350 | 6/1974 | Brandin et al. | 62/193 |
| 3,913,346 | 10/1975 | Moody, Jr. et al. | 62/505 X |
| 3,922,114 | 11/1975 | Hamilton et al. | 62/469 X |

FOREIGN PATENT DOCUMENTS

| | | | |
|---|---|---|---|
| 938313 | 8/1955 | Fed. Rep. of Germany . | |
| 1240366 | 7/1960 | France . | |
| 2089717 | 1/1972 | France . | |
| 2273242 | 12/1975 | France . | |
| 2341759 | 9/1977 | France . | |
| 570780 | 7/1945 | United Kingdom . | |
| 1352698 | 5/1974 | United Kingdom | 62/605 |

*Primary Examiner*—Harry Tanner

*Attorney, Agent, or Firm*—Ziems, Walter & Shannon

[57] ABSTRACT

Refrigerant liquid containing a little oil dissolved is vaporized while cooling the motor and a portion of the vaporization products is sent into the bearings to be lubricated.

The large excess of available heat permits dispensing with an oil recirculating pump and keeping in the motor casing, acting as a sump, the major part of the oil present.

11 Claims, 5 Drawing Figures

METHOD OF LUBRICATING BEARINGS OF A REFRIGERATION OR THE LIKE COMPRESSOR

This invention relates to a method of lubricating bearings of a refrigeration or the like compressor.

This invention also relates to a machine in which said method is used.

It is known to use single screw compressors as described in French patent Nos. 1,331,998 and 1,586,832 to compress refrigerant gases, such as halocarbons, injecting condensate into the compression chamber to cool the compressor. Such a device is known for example through French patent No. 2,089,717.

It is nevertheless necessary to ensure a lubrication of the bearings and this can be achieved in a conventional way, by sending into the bearings oil by taking oil from a sump by means of an auxiliary pump and returning the oil after lubrication to said sump. Such a device is, for example, disclosed in the document "The development of the single screw compressor and Oil Reduced Operation" by G. F. HUNDY et al, published in 1982 by "The Institute of Refrigeration", especially in its FIG. 7.

This method is nevertheless expensive because it requires an auxiliary tank and a pump; moreover, as occasional oil leaks towards the refrigerating circuit may occur, it is necessary to continuously restore the oil level, for instance by boiling off a part of the liquid condensate by means of auxiliary heating means, and by sending the oil contained in the distillate into the aforesaid sump. This adds to the complexity.

According to the invention, a method of lubricating bearings in a refrigeration or the like compressor, driven by a hermetic electric motor, comprises the steps of:

dissolving a small percentage of oil in a liquid refrigerant used in the compressor;

supplying at least part of the obtained liquid mixture in a casing of the motor;

vaporizing said mixture with heat provided by the motor as a result of its operation;

supplying from said casing of the motor to an intake of the compressor through the bearings at least part of a fluid having resulted from said vaporization of said mixture.

"Hermetic electric motor" designates an electric motor rotating inside a casing hermetically connected to the remainder of the refrigerating circuit, the inside of the casing being filled by the refrigerating gas circulating in the circuit.

This method indeed has several advantages.

First, the heat generated by the electric motor being very large permits boiling off a large quantity of liquid, thus producing an important volume of oil; it is then no more necessary to return the oil which has lubricated the bearings to the sump and to recirculate it by means of a pump; the oil having lubricated the bearing is simply drawn into the compressor, compressed and it returns with the liquid in order to be again separated by vaporizing. It is thus possible to cancel the pump and the complex circuits around it.

Alternately, the oil is separated by decanting in the casing enclosing the motor. On one hand, this permits having an oil sump which costs practically nothing, thereby permitting to monitor, e.g. through a sight glass, the oil contained in the system or to replace it easily. On the other hand, the heating power offered by the motor exceeds by so far the vaporizing power necessary to lubricate the bearings that it ensures said lubrication with very reduced percentages of oil in the refrigerant; thereby the major part of the oil in the system is permanently in the motor casing and is very quickly returned to said casing in case of an accidental departure.

In a second alternate version, the casing is isolated from intake by means of sealing means and connected to an orifice in the compressor, subject to a pressure intermediate between intake and discharge pressure.

This ensures not only a well known improvement of the system efficiency, it also provides a rather constant difference between the casing and the bearing pressures, thus ensuring a relatively constant lubricant flow.

According to another object of the invention, a machine such as a refrigerating machine or a heat pump comprises a refrigeration compressor with an intake and at least one rotary element supported by at least one bearing, said compressor being coupled to an electric driving motor arranged in an hermetic casing which is in fluid connection with the compressor by at least one passage through the bearing and is connected to a refrigerating circuit through a conduit, wherein the conduit is connected to the refrigerating circuit at a region thereof adapted to at least partly contain liquid refrigerant.

In a preferred embodiment of the machine according to this invention, the casing around the motor comprises a volume forming a sump, and one conduit means at least ends in the compressor housing in a point located between intake and discharge.

This invention will be better understood when reading the description hereinafter and the attached drawings, shown as non limiting examples, where:

Figure 1:
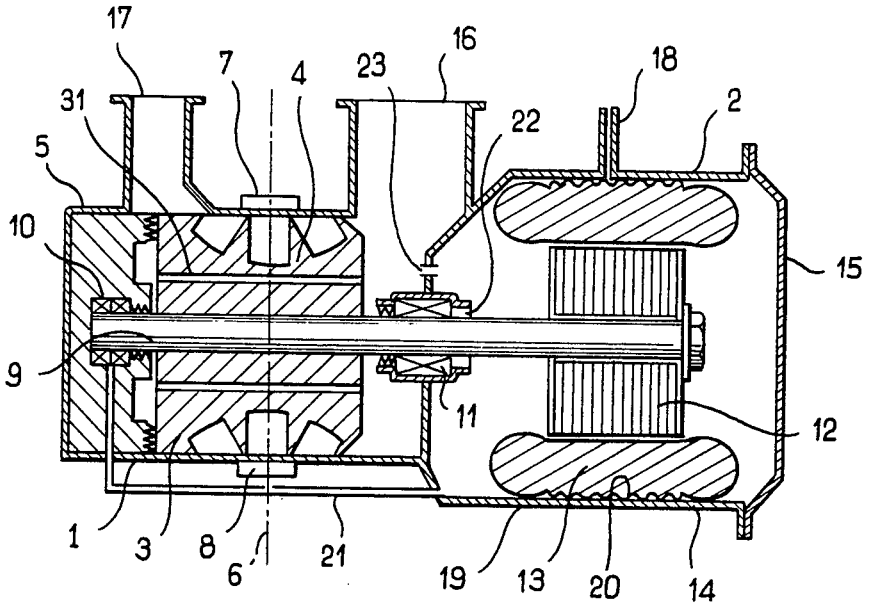
FIG. 1 is a sectional view of a motor-compressor allowing to work the method according to the invention.

With reference to FIG. 1, a compressor 1 is driven by a hermetic electric motor 2.

In the example as shown, the compressor 1 is of the type disclosed in French patent No. 1,331,998 and comprises a screw 3 having threads 4, rotating in a housing 5, and meshing in a known way with two symmetrical pinion wheels not shown here, the axis of one of them being visible in 6 and rotating in non visible bearings located in swells 7 and 8. The pinion wheels are arranged symmetrically with respect to the axis of the screw 3.

The screw 3 is secured to an axial shaft 9 mounted therethrough. Said shaft 9 is rotatably mounted in bearings 10, 11 at both ends of the screw. Beyond bearing 11, the shaft 9 carries a rotor 12 of the motor 2. The rotor 12 rotates in a stator 13 arranged in a casing 14 closed by a lid 15.

The compressor has an intake 16 and a discharge 17, the intake 16 being adjacent the casing 14 of motor 2.

Through the casing 14 arrives, in a way known per se, a conduit 18 ending in a zone 19 between the stator 13 and the casing 14 where are provided helix-shaped grooves 20.

A conduit 21 connects the casing 14 with the bearings 10 supporting shaft 9 away from casing 14 and with the pinion wheel bearing contained in swell 8; other conduits, not shown, connect in the same way the casing 14 with the other bearings, i.e. the bearing located in swell 7 and with the two bearings of the other pinion wheel, not shown because located forward of the drawing.

There is provided between the casing 14 and the shaft 9 a passage 22 ending on the bearing 11 as well as an orifice 23 between the casing 14 and the intake 16.

Figure 2:
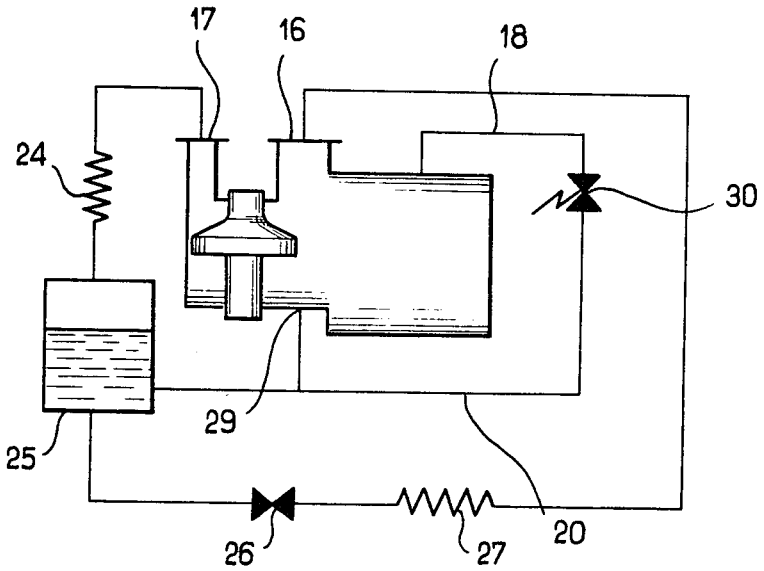
FIG. 2 is a schematic view showing the implementation of the motor-compressor of FIG. 1 in a refrigerating circuit.

FIG. 2 shows the implementation of the device of FIG. 1 in a refrigerating circuit.

The discharge 17 is in fluid connection with a refrigerating circuit comprising, in this order from discharge 17, a condenser 24, a tank or receiver 25, an expansion valve 26 and an evaporator 27, this latter being in fluid connection with intake 16. The bottom of receiver 25 is connected to a conduit 28 connected to a liquid injection port 29 which is provided through the housing 5 of the compressor to cool the compressor as taught by French patent No. 2,089,717. The injection port 29 has been omitted in FIG. 1. Conduit 28 is, on the other hand, connected to conduit 18 through a control valve 30.

In a way, not shown here because known per se, such valve is, for instance, a thermostatic valve, the opening of which is controlled by a thermostat located in the motor windings or by a bulb measuring the superheat of the gas leaving the inside of the casing through the orifice 23.

The condensed liquid, contained in the receiver 25, is complemented by oil, between a fraction of a percent and a few percent, say for instance 1%, when the system is initially started up.

The method of lubricating the bearing is thus as follows:

The liquid refrigerant containing dissolved oil is injected into the motor through conduit 18 and vaporizes while cooling the motor.

The boiled off gases containing oil in suspension are then directed via passage 22 or conduits such as 21 toward the various bearings, which they lubricate during their transit, before returning to compressor intake and being recompressed. On FIG. 1, one sees for instance openings 31 provided axially through the screw 3, so as to allow the gas loaded with oil having travelled through bearings 10 to return to intake 16.

The bearing 11 is in direct fluid communication with intake 16, although a means such as a labyrinth may be provided for slowing fluid flow through bearing 11. The bearings supporting the pinion-wheels are also in such a direct communication with intake 16 because, as known per se, the passage ways provided in housing 5 for the pinion-wheels are subjected to the intake pressure of the compressor. The pathes between casing 14 and intake 16 via the bearings and conduit 21 or passage 22 or the like allow a certain pressure drop between casing 14 and intake 16.

Using the heat from the electric motor to vaporize the liquid ensures a large excess lubrication, which permits dispensing with arranging for oil a separate circuit with a pump and a separate tank.

Tests have indeed shown that on a compressor of approximately 30 kolowatts, compressing Refrigerant 22 to condensing pressures of 10 to 30 bars, 300 W to 500 W are necessary to vaporize the volume of gas and oil necessary for lubrication when the amount of oil is around 2% by weight.

But in a hermetic compressor, the heat dissipated by the motor is of the order of 7% to 10% of the motor power, in other words 2 to 3 kW, i.e. 4 to 10 times the amount needed.

This results in an excess in lubricating capacity which ensures that, even if by accident the amount of oil would decrease, because for example the oil has accumulated in some remote point of the circuit, enough oil remains available for lubrication: this excess allows also to use a smaller percentage amount of oil, which eventually results in a better efficiency of the evaporator and condenser.

Especially, the excess can be controlled by sizing the orifice 23. Moreover, by locating the orifice 23 in the upper section of the casing and the conduit 21 in the lower section of the casing, the gases leaving via the conduit 21 contain more oil because the droplets tend to fall by gravity into the lower section of the casing 14.

Figure 3:
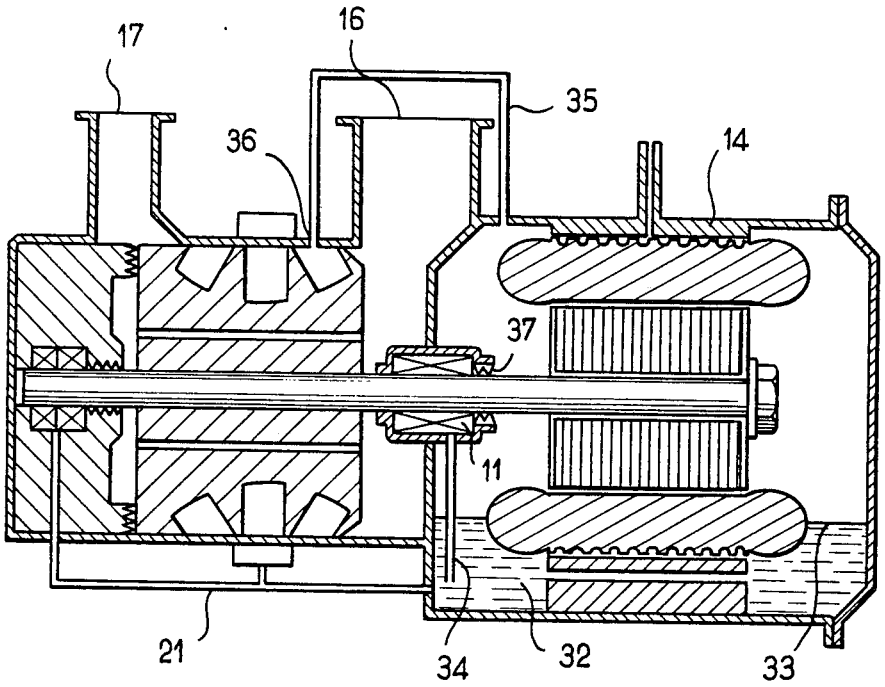
FIG. 3 shows an alternative embodiment in a view as in FIG. 1.

FIG. 3 shows an alternative embodiment of the machine corresponding to a variant of the method according to the invention.

The casing 14 is somewhat enlarged towards its bottom so as to provide a pocket such as 32 for oil accumulation, the level of which, shown in 33, is above the adjacent end of the conduits such as 21. A conduit 34 communicating with bearing 11 opens in pocket 32 under level 33. Bearing 11 is separated from casing 14 by a seal 37 or the like.

To provide such an oil accumulation, the conduits such as 21 or 34 have a relatively small diameter. Thus, the gaseous flow rate therethrough is very small in weight, entailing accumulation and subsequently liquid flow with convenient flow rate in weight.

Oil accumulates by gravity; centrifugal force of the rotor could also be used to improve this separation. The separated gas could leave the casing 14 through an orifice 23 such as that of FIG. 1.

The pressure drop created by the orifice 23 is then sufficient to urge the accumulated oil toward the bearings via conduit means such as 21 or 34.

In the preferred alternative embodiment as shown, the casing is in fluid communication, via a conduit 35, with an orifice 36 which is provided through the housing 5 at a position subjected to a pressure intermediate between intake pressure and discharge pressure, preferably as near as possible of intake pressure.

This embodiment has not only the advantage, known per se, to avoid transferring motor heat to intake, so as to improve the efficiency of the thermodynamic cycle, it also permits maintaining a substantially stable pressure differential between the casing 14 and the intake of the compressor, thus ensuring a substantially stable oil flow rate.

Indeed, when intake pressure varies (because evaporator temperature changes), the flow of gas passing through the orifice 23 of FIG. 1 varies as the inverse proportion, and for a pressure reduction of one half, the gas flow is approximately duplicated, so as to result in quadruplicating the pressure differential.

When, on the contrary, the conduit 35 is connected to a point in the compression range and if the pressure in the casing 14 balances this pressure (by providing conduit 35 wide enough to avoid any significant pressure drop), the pressure in the casing varies as the intake pressure, thus the pressure differential with intake only doubles.

Figure 5:
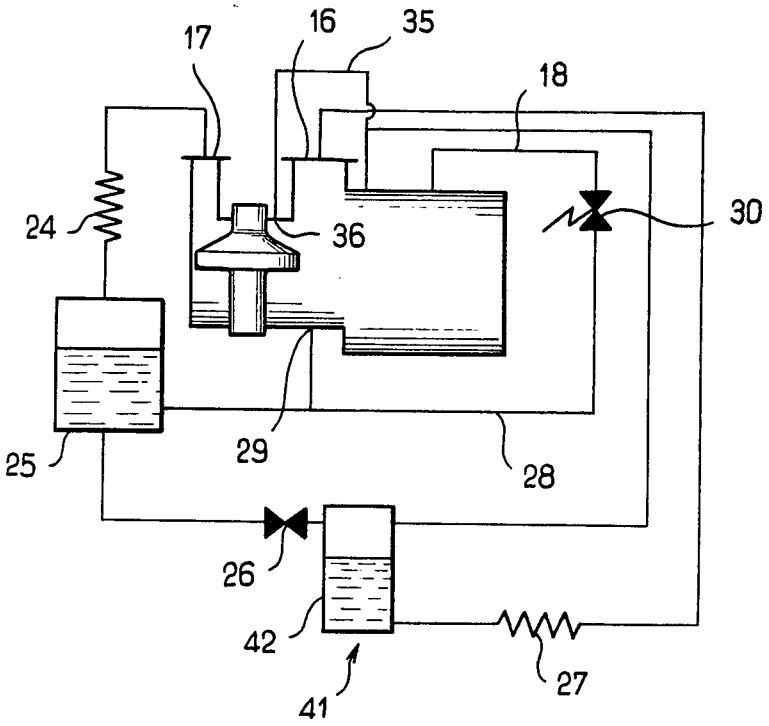
FIG. 5 is a view as in FIG. 2, but concerning an alternative embodiment.

Moreover, as shown in FIG. 5, the orifice 36 may be an economiser port of an economiser device 41 comprising, in a manner known per se, a liquid/gas separating device such as a tank 42 mounted between the expansion device 26 and the evaporator 27. The bottom of tank 42, containing condensate when in operation, is connected to an inlet of the evaporator 27. The top of tank 42, containing gaseous refrigerant, is connected to the economiser port 36.

As is known, the more the intake pressure diminishes, the more the compression ratio increases, the more gas is returned to the economiser, the higher is the pressure ratio between pressure 36 and intake pressure.

For example, in a compressor discharging under a pressure of 12 bars, with an economiser orifice for two pinions as described in the French patent application No. 79 15675 of June 19, 1979, if intake pressure is 4 bars, the pressure of the economiser, i.e. at orifice 36 is approximately 6 bars, thus a difference of 2 bars; but if intake pressure drops to 2 bars, the economiser pressure climbs to approximately 4 bars, which more or less maintains the pressure difference.

It would nevertheless be possible, without changing the invention, but at the expense of an additional device, to maintain a constant oil pressure by moving the point 36 towards intake and by implementing on the conduit 35 a constant pressure drop valve.

One shall notice that the level of liquid 33 tends to self-stabilize. If it decreases, the oil content of the liquid in the receiver 25 increases, thus increasing the quantity of oil produced by distillating it.

A fast stabilisation is only made possible because the vaporizing heat supplied by the motor is in large excess with respect to the lubrication needs.

The method according to this invention uses for the lubrication of the bearings in the case of FIG. 1 the vaporized gases carrying oil, and in the case of FIG. 3 the oil separated after vaporization; one could also, without changing the invention, spray said oil again by known means into a part of the vaporized gas so as to send into the bearings gas heavily loaded with oil.

Figure 4:
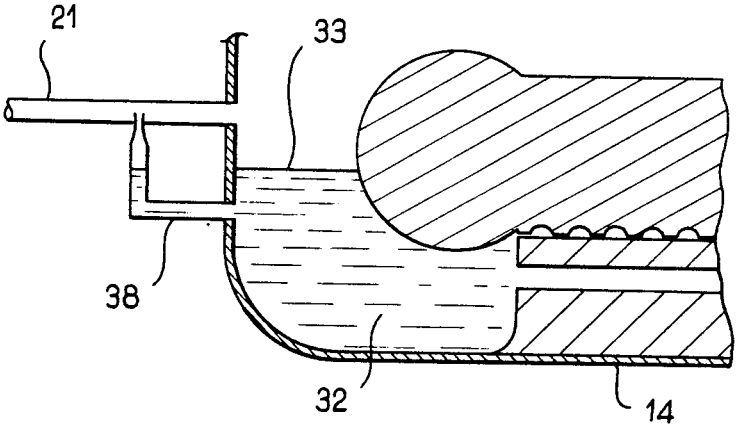
FIG. 4 is an alternate version of a detail of FIG. 3.

A device for carrying out this method is shown in FIG. 4; the conduit 21 merges into the casing above the level 33 and a pipe 38 leading into conduit 21 is connected to the casing 14 below the level 33. At the intersection of the two pipings, a Venturi effect occurs, and in a known way a spray of oil into the gas jet is created.

We claim:

1. A method of lubricating bearings in a refrigeration or the like compressor driven by a hermetic electric motor, comprising the steps of:

dissolving a small percentage of oil in a liquid refrigerant used in the compressor;

supplying at least part of the obtained liquid mixture in a casing of the motor;

preparing in the motor casing a lubricating fluid from said mixture by vaporizing said mixture with heat provided by the motor as a result of its operation; and supplying from said casing of the motor to an intake of the compressor through the bearings at least part of said lubricating fluid.

2. A method according to claim 1, wherein after said vaporization, liquid oil is collected in said casing by decantation, and at least part of said oil is used to constitute at least part of said fluid supplied to the intake of the compressor through the bearings.

3. A method according to claim 2, wherein said oil is carried along from the casing through the bearings by gas resulting from said vaporization.

4. A method according to claim 1, wherein for supplying said fluid from the casing to the intake of the compressor, the pressure in the casing is maintained at a higher level than the pressure in the intake of the compressor.

5. A method according to claim 4, wherein the casing is connected with a region of the compressor where the pressure is in operation higher than in the intake of the compressor, and a pressure drop is established between the casing and the intake of the compressor through the bearings.

6. A machine such as a refrigerating machine or a heat pump, comprising a refrigeration compressor and, between an intake and an exhaust of the compressor, a refrigerating circuit containing a refrigerant fluid in which a small percentage of oil is dissolved, the compressor being provided with at least one rotary element supported by at least one bearing and being coupled to an electric driving motor arranged in an hermetic casing which is in fluid connection with the compressor by at least one passage through the bearing and is connected to a refrigerating circuit through a conduit, wherein the conduit is connected to the refrigerating circuit at a region thereof adapted to at least partly contain liquid refrigerant with oil in solution.

7. A machine according to claim 6, wherein said passage communicates with the casing substantially in a lower part thereof.

8. A machine according to claim 6, wherein said region of the refrigerating circuit is located between a condenser and an expansion device of the refrigerating circuit.

9. A machine according to claim 8, wherein said conduit is in fluid connection with said region of the refrigerating circuit through a means for regulating the flow to the casing as a function of the need of cooling of the motor.

10. A machine according to claim 8, wherein said region of the refrigerating circuit is also in fluid connection with a port for injecting liquid into the compressor.

11. A machine according to claim 8, wherein the refrigerating circuit comprises an economiser device connected to an economiser port of the compressor, said economiser port being located in order to be in operation subjected to a pressure intermediate between an intake pressure and an exhaust pressure of the compressor, the casing of the motor being in fluid connection with the economiser port.

* * * * *